US011158249B2

(12) United States Patent
Yamashita et al.

(10) Patent No.: US 11,158,249 B2
(45) Date of Patent: Oct. 26, 2021

(54) DISPLAY DRIVING DEVICE, METHOD AND OLED DISPLAY DEVICE

(71) Applicant: Everdisplay Optronics (Shanghai) Co., Ltd., Shanghai (CN)

(72) Inventors: Keitaro Yamashita, Shanghai (CN); Chungche Tsou, Shanghai (CN); Yinan Liang, Shanghai (CN); Shaodong Ma, Shanghai (CN)

(73) Assignee: Everdisplay Optronics (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/091,285

(22) Filed: Nov. 6, 2020

(65) Prior Publication Data

US 2021/0142724 A1 May 13, 2021

(30) Foreign Application Priority Data

Nov. 8, 2019 (CN) ..... 201911086655.4

(51) Int. Cl.
*G09G 3/3225* (2016.01)
*G09G 3/20* (2006.01)

(52) U.S. Cl.
CPC ..... *G09G 3/3225* (2013.01); *G09G 3/2096* (2013.01); *G09G 2310/08* (2013.01); *G09G 2320/0252* (2013.01); *G09G 2360/12* (2013.01)

(58) Field of Classification Search
CPC ..... G09G 3/3225; G09G 3/2096; G09G 2310/08; G09G 2320/0252; G09G 2360/12
See application file for complete search history.

(56) References Cited

U.S. PATENT DOCUMENTS

2001/0028346 A1 10/2001 Kudo
2012/0044252 A1 2/2012 Kamimura
(Continued)

FOREIGN PATENT DOCUMENTS

CN 103794168 A 5/2014
CN 104036713 A 9/2014
(Continued)

OTHER PUBLICATIONS

The 1st Office Action dated Aug. 31, 2021 for CN patent application No. 201911086655.4.

*Primary Examiner* — Christopher J Kohlman
(74) *Attorney, Agent, or Firm* — Qinghong Xu

(57) ABSTRACT

The present disclosure provides a display driving device, method and an OLED display device, and the display driving device includes: an interface module, configured to receive image data of a display chip and sending a first scanning signal in each of frame periods; a frame buffer, configured to send a buffer signal after receiving the first scanning signal from the interface module; a timing controller, configured to send a second scanning signal to the display panel according to the buffer signal sent by the frame buffer; in response to the display driving device is switched from a screen self-refresh mode to a vertical synchronization mode, the delay time between the second scanning signal and the buffer signal gradually decreases, one frame period by one frame period, to zero or gradually increases, one frame period by one frame period, to duration of one frame period. When the display device is switched back to the vertical synchronization mode, the present disclosure causes the vertical synchronization signal generated by the display chip and the timing controller to be resynchronized for reducing phase mismatch, thereby improving display response speed of the display device.

17 Claims, 9 Drawing Sheets

(56) References Cited

U.S. PATENT DOCUMENTS

| | | | | |
|---|---|---|---|---|
| 2016/0379584 | A1* | 12/2016 | Onishi | G09G 3/2025<br>345/691 |
| 2018/0204502 | A1* | 7/2018 | Sung | G09G 3/2092 |

FOREIGN PATENT DOCUMENTS

| | | | |
|---|---|---|---|
| CN | 104517555 | A | 4/2015 |
| CN | 104795031 | A | 7/2015 |
| CN | 108694901 | A | 10/2018 |

* cited by examiner

DISPLAY DRIVING DEVICE, METHOD AND OLED DISPLAY DEVICE

CROSS REFERENCE TO RELATED APPLICATIONS

The present application is based upon and claims the priority of Chinese Patent Application No. 201911086655.4, titled "DISPLAY DRIVING DEVICE, METHOD AND OLED DISPLAY DEVICE", filed on Nov. 8, 2019. The entire content of this Chinese patent application is incorporated herein by reference.

TECHNICAL HUD

The present disclosure relates to the field of display technology, and in particular, to a display driving device, method and an OLED (Organic Light-Emitting Diode) display device.

BACKGROUND

AMOLED (Active Matrix Organic Light Emitting Diode) display is an active self-luminous display, and is usually used for high-resolution large-sized display devices, which provides current to an OLED device through a pixel circuit constructed by Thin Film Transistor (TFT).

SUMMARY

In view of the defects in the prior art, an object of the present disclosure is to provide a display driving device, method and an OLED display device.

According to an aspect of the present disclosure, a display driving device is provided for driving an OLED display panel, including:

an interface module, configured to receive image of a display chip and send a first scanning signal in each frame period;

a frame buffer, configured to send a buffer signal after the first scanning signal is received from the interface module;

a timing controller, configured to send a second scanning signal to the display panel according to the buffer signal sent by the frame buffer;

when the display driving device is switched to a vertical synchronization mode, delay time between the second scanning signal and the buffer signal gradually decreases, one frame period by one frame period, to zero or gradually increases, one frame period by one frame period, to duration of one frame period.

In an embodiment, the timing controller is configured to set, according to delay time $Td_1$ corresponding to a first image frame after switching to the vertical synchronization mode, the delay time corresponding to each of subsequent image frames, causing the delay time decreases to zero from time $Td_1$ after m image frames.

In an embodiment, after $T_{phase1}$ elapses, the delay time gradually decreases to zero from the time $Td_1$, and the time $T_{phase1}$ satisfies a following equation:

$$T_{phase1} = \frac{Td_1}{mT_H} * T_F (0 \le Td_1 \le T_F)$$

where $T_H$ is horizontal synchronization time, $T_F$ is duration of one frame period of the interface module, and m is a first preset synchronization cycle number.

In an embodiment, the timing controller is configured to set, according to delay time $Td_1$ corresponding to a first image frame after switching to the vertical synchronization mode, the delay time corresponding to each of subsequent image frames, causing the delay time increases to duration of one frame period from time $Td_1$ after n image frames.

In an embodiment, after $T_{phase2}$ elapses, the delay time gradually increases to the duration of one frame period $T_F$ from the time $Td_1$ and the time $T_{phase2}$ satisfies a following equation:

$$T_{phase2} = \frac{(T_F - Td_1)}{mT_H} * T_F (0 \le Td_1 \le T_F)$$

where $T_H$ is horizontal synchronization time, and n is a second preset synchronization cycle number.

In an embodiment, when the display driving device is switched to the vertical synchronization mode, the timing controller determines whether the delay time corresponding to a first image frame is less than or equal to half of the duration of one frame period of the interface module;

when the delay time corresponding to the first image frame is less than or equal to half of the duration of one frame period of the interface module, the delay time between the second scanning signal and the buffer signal gradually decreases, one frame period by one frame period, to zero;

when the delay time corresponding to the first image frame is larger than half of the duration of one frame period of the interface module, the delay time between the second scanning signal and the buffer signal gradually increases to the duration of one frame period.

In an embodiment, after $T_{phase}$ elapses, the second scanning signal and the buffer signal are synchronized, and the time $T_{phase}$ satisfies a following equation:

$$T_{phase} = \begin{cases} \frac{Td_1}{mT_H} * T_F, & 0 \le Td_1 \le \frac{T_F}{2} \\ \frac{(T_F - Td_1)}{nT_H} * T_F, & \frac{T_F}{2} < Td_1 \le T_F \end{cases}$$

where $Td_1$ is the delay time corresponding to the first image frame after switching to the vertical synchronization mode, $T_H$ is horizontal synchronization time, $T_F$ is the duration of one frame period of the interface module, m is a first preset synchronization cycle number and n is a second preset synchronization cycle number.

In an embodiment, the frame buffer is configured to communicate with the interface module and the timing controller by using separate read data bus and write data bus respectively.

According to another aspect of the present disclosure, a display driving device is further provided for driving an OLED display panel. The display driving device includes:

an interface module, configured to receive image data of a display chip and send a first scanning signal in each frame period;

a frame buffer, configured to send a buffer signal after the first scanning signal is received from the interface module;

a timing controller, configured to send a second scanning signal to the display panel according to the buffer signal sent by the frame buffer;

after the display driving device is switched from a screen self-refresh mode to a vertical synchronization mode, the timing controller does not send a second scanning signal after the buffer signal of a first frame period is received, and sends the second scanning signal to the display panel after the buffer signal of a second frame period is received.

According to still another aspect of the present disclosure, a display driving method using the display driving device above is further provided, and the method includes:

receiving, by the interface module, external image data, and sending, by the interface module, the first scanning signal in each frame period;

sending, by the frame buffer, the buffer signal after receiving the first scanning signal from the interface module;

sending, by the timing controller, the second scanning signal to the display panel according to the buffer signal sent by the frame buffer; wherein, when the display driving device is switched from a screen self-refresh mode to a vertical synchronization mode, the delay time between the second scanning signal and the buffer signal gradually decreases, one frame period by one frame period, to zero or gradually increases, one frame period by one frame period, to duration of one frame period.

According to another aspect of the present disclosure, an OLED display device is further provided, including an OLED display panel and the above display driving device.

BRIEF DESCRIPTION OF THE DRAWINGS

Other features, objects, and advantages of the present disclosure will become more apparent by reading the detailed description of the non-limited embodiments with reference to the following drawings.

DETAILED DESCRIPTION

Figure 1:
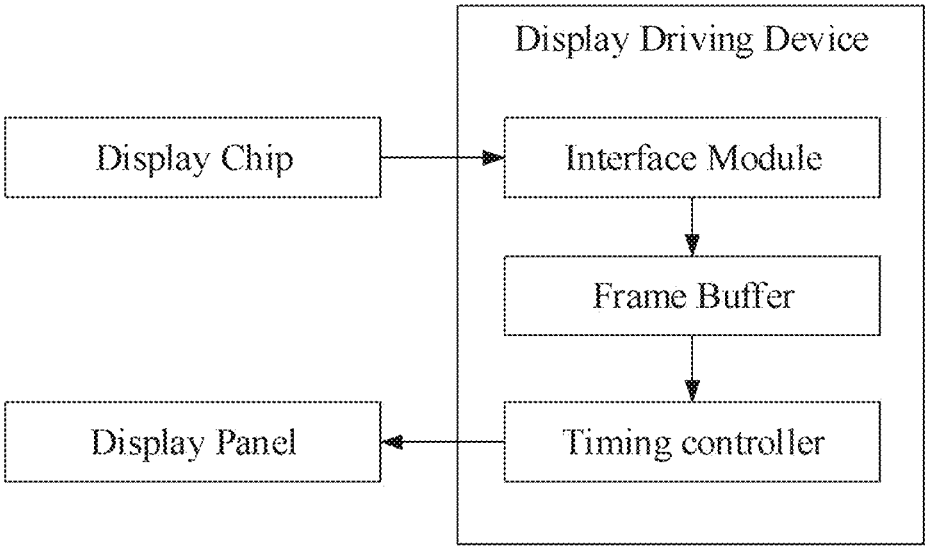
FIG. 1 is a schematic structural diagram of a display driving device according to an embodiment of the present disclosure.

Example embodiments will now be described more fully with reference to the accompanying drawings. However, the example embodiments can be implemented in various forms and should not be construed as limited to the embodiments set forth herein; rather, these embodiments are provided so that the present disclosure will be comprehensive and complete, and the concept of the example embodiments will be fully conveyed to those skilled in the art. The same reference numerals in the drawings denote the same or similar structures, and their repeated description will be omitted.

The described features, structures, or characteristics may be combined in any suitable manner in one or more embodiments. In the following description, numerous specific details are provided to give a thorough understanding of the embodiments of the present disclosure. However, those skilled in the art should realize that the technical solution of the present disclosure can also be practiced without one or more of the specific details, or by using other methods, components, materials, and the like. In some cases, well-known structures, materials, or operations have not been shown or described in detail to avoid obscuring the disclosure.

In a panel self-refresh (PSR) mode of an OLED display device, a display chip (Graphics Processing Unit, GPU) keeps hanging a vertical synchronization signal (V-sync) transmitted to a timing controller (T-con) through an eDP (Embedded DisplayPort) interface, and the timing controller will keep displaying a static picture based on its own frame memory and its vertical synchronization signal generated by a phase-locked loop (PLL).

When the OLED display device exits the panel self-refresh mode, although the display chip re-sends the vertical synchronization signal to the timing controller, a phase of the vertical synchronization signal from the display chip does not match a phase of the vertical synchronization signal of the timing controller. Due to the phase mismatch, the timing controller has to use a frame buffer to buffer received new image frame data before a scanning of the current image frame is finished.

A maximum buffer delay is changed based on a length of the mismatched phase, and the maximum of the maximum buffer delay may be duration of one frame period (e.g., 16.6 ms at 60 Hz). This potential factor affects quick response from action (e.g., pressing a button that responds to the display) to display.

As shown in FIG. 1, the present disclosure provides a display driving device for driving an OLED display panel. The display driving device includes:

an interface module, configured to receive image data of display chip (GPU) and send a first scanning signal in each frame period. The interface module may be an eDP interface module, and the eDP interface is a fully digital interface based on the DisplayPort architecture and protocol. The eDP interface may transmit high-resolution signals by using simple connectors and few pins and may transmit multiple data simultaneously;

a frame buffer, configured to send a buffer signal when the first scanning signal is received from the interface module;

a timing controller, configured to send a second scanning signal to the display panel according to the buffer signal sent by the frame buffer;

when the display driving device is switched to a vertical synchronization mode, corresponding to each frame period, delay time between the second scanning signal and the buffer signal gradually decreases to zero or gradually increases to duration of one frame period.

According to the present disclosure, through adjustment, by the timing controller, of decreasing or increasing the delay time between the second scanning signal and the buffer signal, when the display device is switched back to the vertical synchronization mode, the vertical synchronization signals respectively generated by the display chip and the timing controller can be resynchronized for reducing phase mismatch, thereby improving display response speed of the display device.

Figure 2:
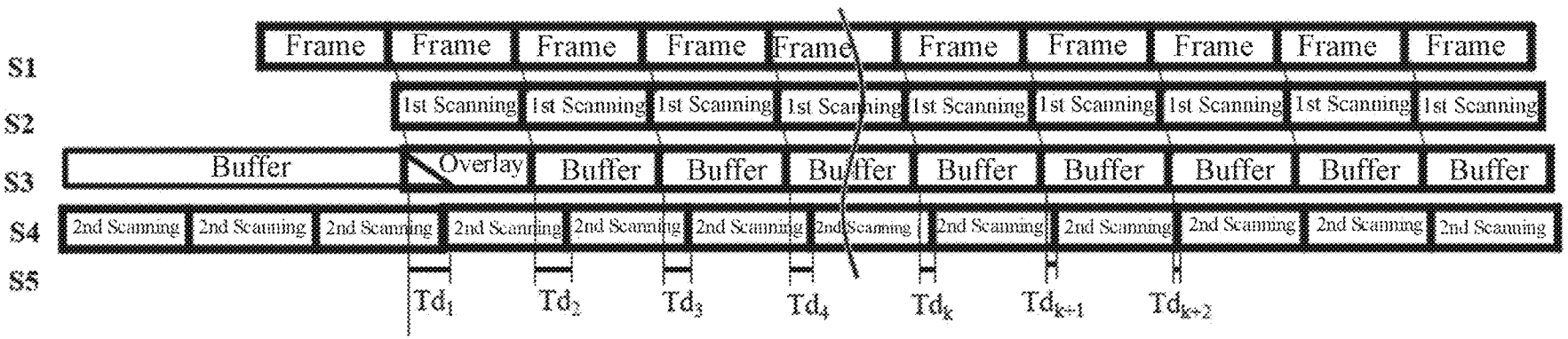
FIG. 2 is a timing chart of signal transmission of the display driving device according to the embodiment of the present disclosure.
Figure 4:
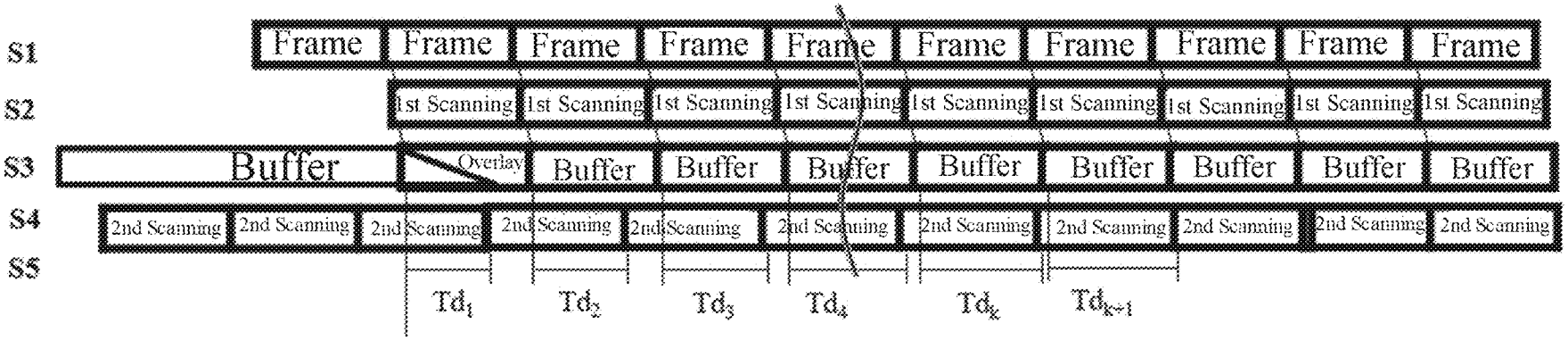
FIG. 4 is a timing chart of signal transmission of the display driving device based on whether delay time corresponding to a first image frame of an embodiment of the present disclosure is less than or equal to half duration of one frame period of the interface module.

The present disclosure mainly provides two methods to adjust the delay time. One is that, the delay time between the second scanning signal and the buffer signal gradually decreases, one frame period by one frame period, to zero; and the other is that, the delay time between the second scanning signal and the buffer signal gradually increases, one frame period by one frame period, to the duration of one frame period. These two methods can be used separately or in combination. For example, as shown in FIG. 2 and FIG. 4, a first image frame after switching to the vertical synchronization mode corresponds to delay time $Td_1$, and a subsequent image frame corresponds to delay time $Td_2$, i.e., the delay time between the second scanning signal and the buffer signal gradually decreases (as shown in FIG. 2) or increases (as shown in FIG. 4) one frame period by one frame period. The two methods are described below respectively.

Figure 3:
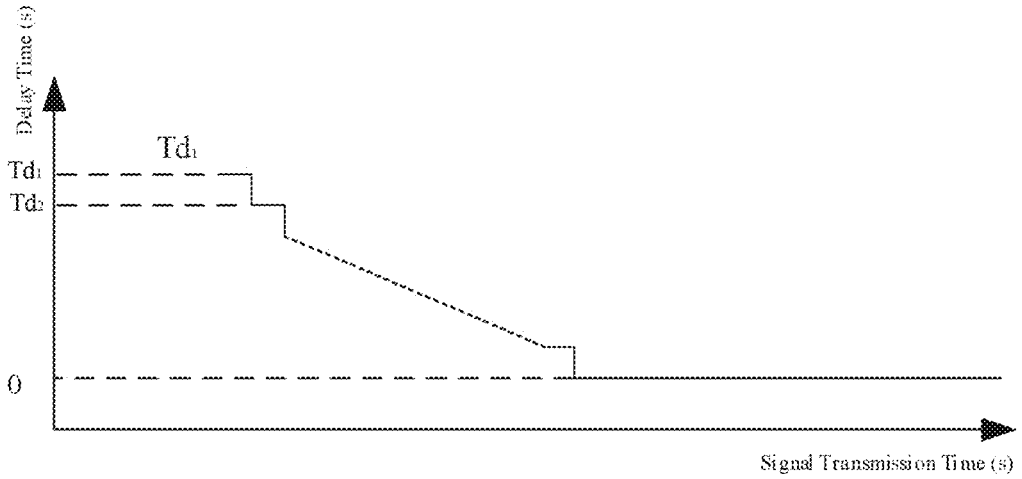
FIG. 3 is a schematic diagram of delay time change according to the embodiment of the present disclosure.

FIG. 2 and FIG. 3 are a timing chart of the display driving device and a schematic diagram of delay time change according to the embodiment of the present disclosure, respectively. In the embodiment, a frame buffer is used to hold a display signal before a scanning of the current display is finished. The timing controller is configured to set the delay time corresponding to each of subsequent image frames according to the delay time $Td_1$ corresponding to a first image frame after switching to the vertical synchronization mode, so that the delay time gradually decreases to zero from the time $Td_1$ after in image frames have passed. In FIG. 2, S1 represents an image frame signal sent by a display chip (GPU), S2 represents the first scanning signal sent by the interface module, S3 represents the buffer signal sent by the frame buffer, and S4 represents the second scanning signal sent by the timing controller, and S5 represents the delay time.

In this embodiment, after $T_{phase1}$ elapses, the delay time gradually decreases to zero from the time $Td_1$, and the time $T_{phase1}$ satisfies the following equation:

$$T_{phase1} = \frac{Td_1}{mT_H} * T_F (0 \le Td_1 \le T_F)$$

where, $T_H$ is horizontal synchronization time, and $T_F$ is duration of one frame period of the interface module, and m is a first preset synchronization cycle number.

In another embodiment, the control of the delay time may be performed in a gradually increasing manner. Specifically, the timing controller is configured to set a delay time corresponding to each of the subsequent image frames according to the delay time $Td_1$ corresponding to the first image frame after switching to the vertical synchronization mode, so that after n image frames, the delay time gradually increases from the time $Td_1$ to duration of one frame period.

In this embodiment, after $T_{phase2}$ elapses, the delay time gradually increases from the time $Td_1$ to duration of one frame period, i.e., $T_F$, and the time $T_{phase2}$ satisfies the following equation:

$$T_{phase2} = \frac{(T_F - Td_1)}{nT_H} * T_F (0 \le Td_1 \le T_F)$$

where $T_H$ is the horizontal synchronization time.

In an embodiment of the present disclosure, the above two methods are combined, that is, the two methods of decreasing the delay time and increasing the delay time are respectively adopted for different situations. Specifically, the method is determined according to the length of the delay time in a first period.

Figure 5:
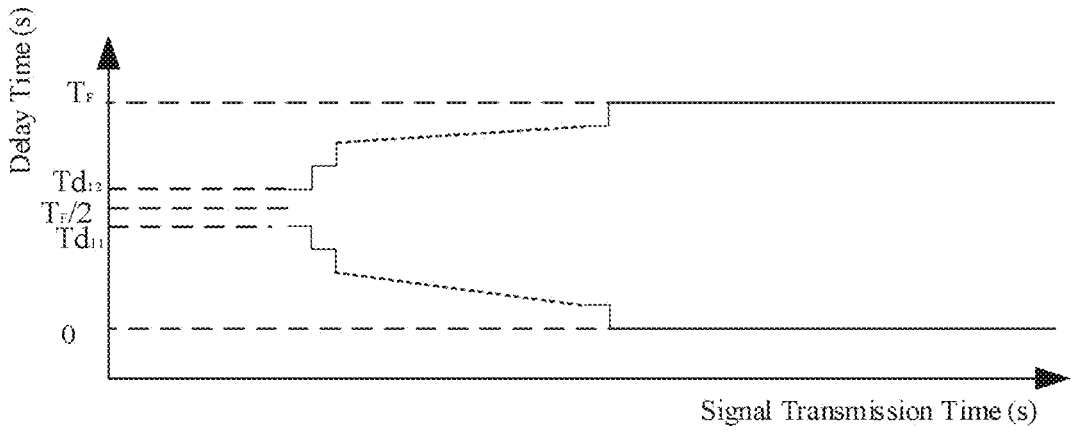
FIG. 5 is a schematic diagram of delay time change according to the embodiment of the present disclosure.

FIG. 4 and FIG. 5 are a timing chart of signal transmission of the display driving device based on whether delay time corresponding to a first image frame of an embodiment of the present disclosure is less than or equal to half duration of one frame period of the interface module and a schematic diagram of delay time change according to the embodiment of the present disclosure, respectively. In FIG. 3 and FIG. 5, the dashed lines indicate steps that are omitted.

In this embodiment, when the display driving device is switched to the vertical synchronization mode, the timing controller determines whether the delay time corresponding to the first image frame is less than or equal to half of the duration of one frame period of the interface module.

If the delay time corresponding to the first image frame is less than or equal to half of the duration of one frame period of the interface module, corresponding to each frame period, the delay time between the second scanning signal and the buffer signal gradually decreases to zero.

If the delay time corresponding to the first image frame is large than half of the duration of one frame period of the interface module, the delay time between the second scanning signal and the buffer signal gradually increases to the duration of one frame period.

In FIG. 4, S1 represents an image frame signal sent by a display chip (GPU), S2 represents the first scanning signal sent by the interface module, S3 represents the buffer signal sent by the frame buffer, S4 represents the second scanning signal sent by the timing controller, and S5 represents the delay time. In FIG. 5, in order to distinguish, $Td_{11}$ represents the delay time change based on the decreasing method, and $Td_{12}$ represents the delay time change based on the increasing method.

In this embodiment, after $T_{phase}$ elapses, the second scanning signal and the buffer signal are synchronized, and the time $T_{phase}$ satisfies the following equation:

$$T_{phase} = \begin{cases} \frac{Td_1}{mT_H} * T_F, & 0 \le Td_1 \le \frac{T_F}{2} \\ \frac{(T_F - Td_1)}{nT_H} * T_F, & \frac{T_F}{2} < Td_1 \le T_F \end{cases}$$

where, $Td_1$ is the delay time corresponding to the first image frame after switching to the vertical synchronization mode, $T_H$ is the horizontal synchronization time, and $T_F$ is the duration of one frame period of the interface module, m and n are a first preset synchronization period number and a second preset synchronization period number, respectively.

Compared with the embodiment above, the total phase adjustment time may be reduced by $T_{phase}$ according to this embodiment.

Figure 6:
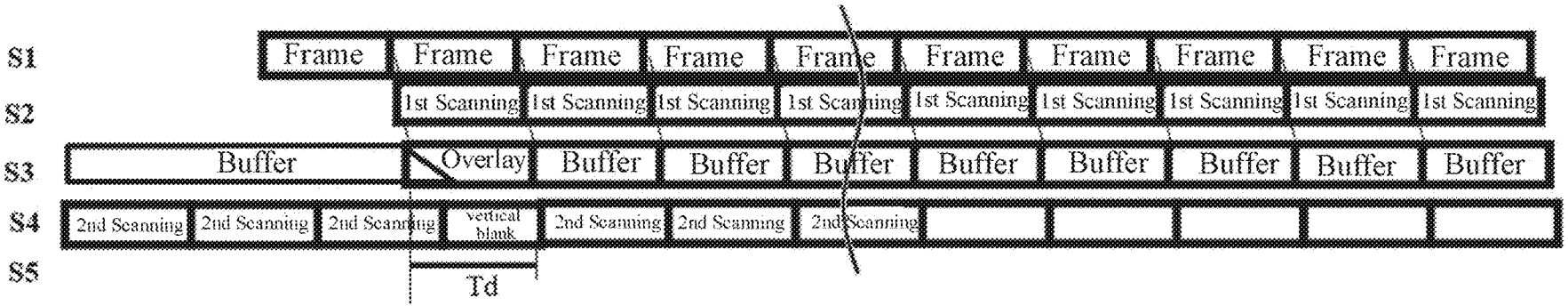
FIG. 6 is a timing chart of signal transmission of a display driving device according to an embodiment of the present disclosure.

FIG. 6 is a timing chart of a display driving device according to an embodiment of the present disclosure. In this embodiment, a display driving device is provided for driving an OLED display panel. The display driving device includes:

an interface module, configured to receive image data of a display chip and send a first scanning signal in each frame period;

a frame buffer, configured to send a buffer signal when the first scanning signal is received from the interface module;

a timing controller, configured to send a second scanning signal to the display panel according to the buffer signal sent by the frame buffer;

after the display driving device is switched from a screen self-refresh mode to a vertical synchronization mode, the timing controller does not send a corresponding second scanning signal after a buffer signal of a first frame period is received, and sends the corresponding second scanning signal to the display panel after a buffer signal of a second frame period is received.

Therefore, in this embodiment, a vertical blank signal is inserted after the display driving device is switched from the screen self-refresh mode to the vertical synchronization mode, and the timing controller sends the corresponding second scanning signal to the display panel after the buffer signal of the second frame period is received, thereby achieving faster synchronization of the buffered signal and the second scanning signal. In this embodiment, the first image frame data is discarded (overlay), however, the image frame data is stored and to be used in the screen self-refresh mode of next time.

Figure 7:
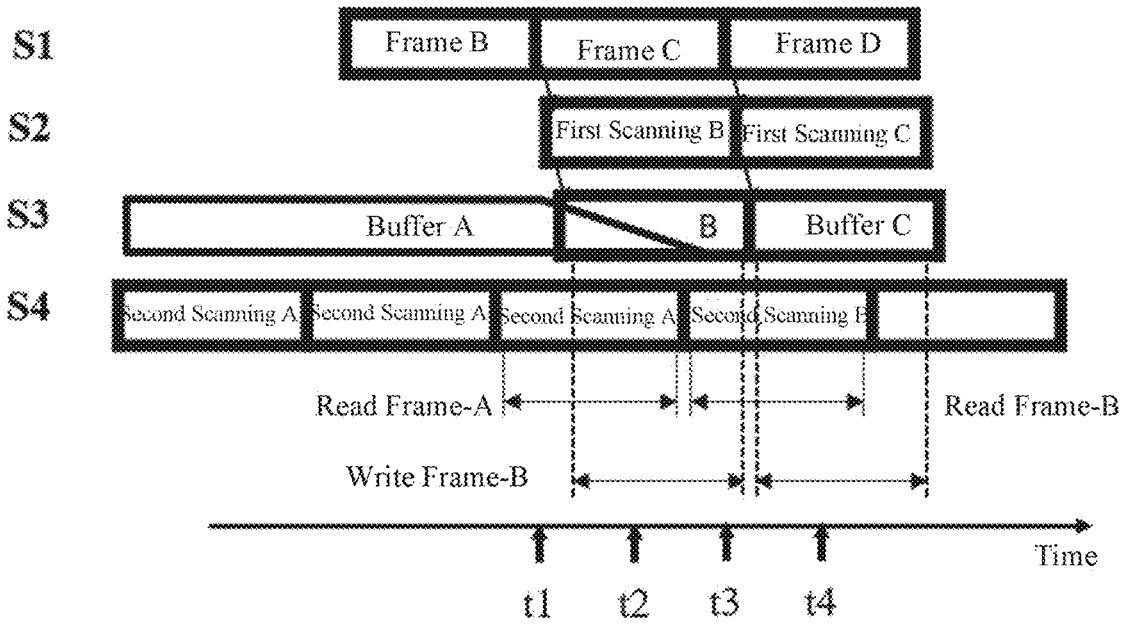
FIG. 7 is a timing diagram of reading and writing image frames according to an embodiment of the present disclosure.
Figure 8:
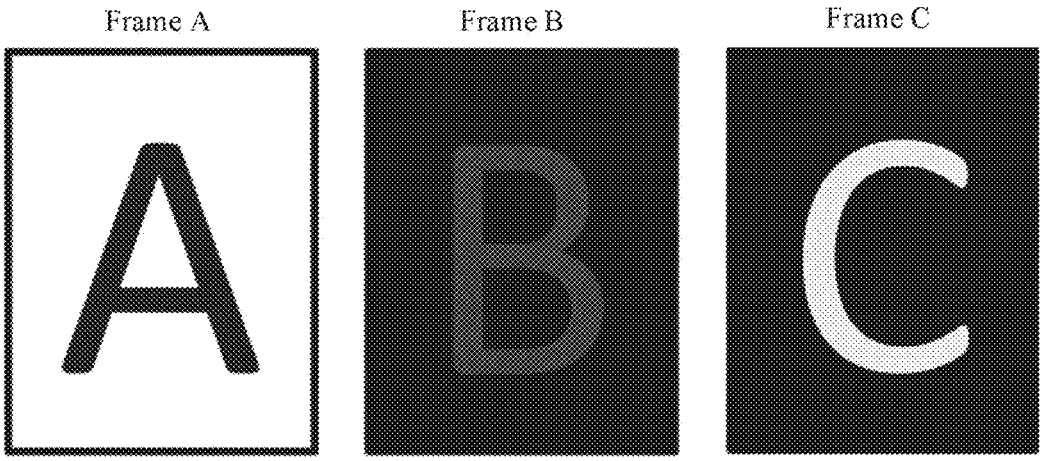
FIG. 8 is a schematic diagram of three image frames according to an embodiment of the present disclosure.
Figure 9:
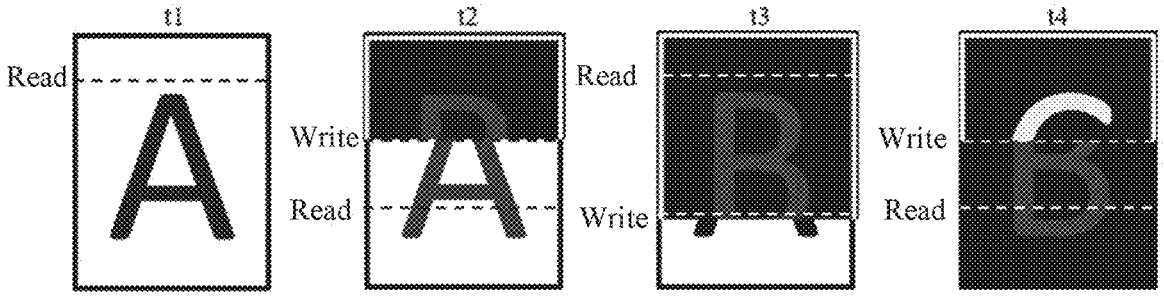
FIG. 9 is a schematic diagram of reading and writing the three image frames in FIG. 8.

As shown in FIG. 7 to FIG. 9, in this embodiment, the frame buffer uses separate read data bus and write data bus to communicate with the interface module and the timing controller, respectively. So that the frame buffer can receive multiple signals simultaneously and thus read operation and write operation may be performed simultaneously.

In an embodiment of the present disclosure, there is further provided a display driving method using the above display driving device, and the method includes:

receiving, by the interface module, external image data, and sending, by the interface module, the first scanning signal in each frame period;

sending, by the frame buffer, the buffer signal after the first scanning signal is received from the interface module;

sending, by the timing controller, the second scanning signal to the display panel according to the buffer signal sent by the frame buffer; and, when the display driving device is switched from the screen self-refresh mode to the vertical synchronization mode, corresponding to each frame period, the delay time between the second scanning signal and the buffer signal gradually decreases to zero or gradually increases to duration of one frame period.

According to the present disclosure, through adjustment, by the timing controller, of decreasing or increasing the delay time between the second scanning signal and the buffer signal, when the display device is switched back to the vertical synchronization mode, the vertical synchronization signals respectively generated by the display chip and the timing controller can be resynchronized for reducing phase mismatch, thereby improving display response speed of the display device.

In an embodiment of the present disclosure, an OLED display device is further provided, including an OLED display panel and the above display driving device.

Compared with the prior art, according to the display driving device, the method and the OLED display device of the present disclosure, when the display device is switched back to the vertical synchronization mode, the vertical synchronization signals respectively generated by the display chip and the timing controller can be resynchronized for reducing phase deviation, thereby improving the display response speed of the display device.

The specific embodiments of the present disclosure have been described above. It should be understood that the present disclosure is not limited to the above specific embodiments, and those skilled in the art can make various changes or modifications within the scope of the claims, which does not affect the essence of the present disclosure.

What is claimed is:

1. A display driving device for driving an OLED display panel, comprising:

an interface module, configured to receive image data of a display chip and send a first scanning signal in each frame period;

a frame buffer, configured to send a buffer signal after the first scanning signal is received from the interface module;

a timing controller, configured to send a second scanning signal to the display panel according to the buffer signal sent by the frame buffer;

wherein, when the display driving device is switched to a vertical synchronization mode, delay time between the second scanning signal and the buffer signal gradually decreases, one frame period by one frame period, to zero or gradually increases, one frame period by one frame period, to duration of one frame period.

2. The display driving device according to claim 1, wherein, the timing controller is configured to set, according to delay time $Td_1$ corresponding to a first image frame after switching to the vertical synchronization mode, the delay time corresponding to each of subsequent image frames, causing the delay time decreases to zero from time $Td_1$ after m image frames.

3. The display driving device according to claim 2, wherein, after $T_{phase1}$ elapses, the delay time gradually decreases to zero from the time $Td_1$, and the time $T_{phase1}$ satisfies a following equation:

$$T_{phase1} = \frac{Td_1}{mT_H} * T_F (0 \le Td_1 \le T_F)$$

where $T_H$ is horizontal synchronization time, $T_F$ is duration of one frame period of the interface module, and m is a first preset synchronization cycle number.

4. The display driving device according to claim 1, wherein, the timing controller is configured to set, according to delay time $Td_1$ corresponding to a first image frame after switching to the vertical synchronization mode, the delay time corresponding to each of subsequent image frames, causing the delay time increases to duration of one frame period from time $Td_1$ after n image frames.

5. The display driving device according to claim 4, wherein, after $T_{phase2}$ elapses, the delay time gradually increases to the duration of one frame period $T_F$ from the time $Td_1$, and the time $T_{phase2}$ satisfies a following equation:

$$T_{phase2} = \frac{(T_F - Td_1)}{mT_H} * T_F (0 \le Td_1 \le T_F)$$

where $T_H$ is horizontal synchronization time, and n is a second preset synchronization cycle number.

6. The display driving device according to claim 1, wherein, when the display driving device is switched to the vertical synchronization mode, the timing controller determines whether the delay time corresponding to a first image frame is less than or equal to half of the duration of one frame period of the interface module;

when the delay time corresponding to the first image frame is less than or equal to half of the duration of one frame period of the interface module, the delay time between the second scanning signal and the buffer signal gradually decreases, one frame period by one frame period, to zero;

when the delay time corresponding to the first image frame is larger than half of the duration of one frame period of the interface module, the delay time between the second scanning signal and the buffer signal gradually increases to the duration of one frame period.

7. The display driving device according to claim 6, wherein, after $T_{phase}$ elapses, the second scanning signal and the buffer signal are synchronized, and the time $T_{phase}$ satisfies a following equation:

$$T_{phase} = \begin{cases} \frac{Td_1}{mT_H} * T_F, & 0 \le Td_1 \le \frac{T_F}{2} \\ \frac{(T_F - Td_1)}{nT_H} * T_F, & \frac{T_F}{2} < Td_1 \le T_F \end{cases}$$

where $Td_1$ is the delay time corresponding to the first image frame after switching to the vertical synchronization mode, $T_H$ is horizontal synchronization time, $T_F$ is the duration of one frame period of the interface module, m is a first preset synchronization cycle number and n is a second preset synchronization cycle number.

8. The display driving device according to claim 1, wherein, the frame buffer is configured to communicate with the interface module and the timing controller by using separate read data bus and write data bus respectively.

9. A display driving device for driving an OLED display panel, comprising:

an interface module, configured to receive image data of a display chip and send a first scanning signal in each frame period;

a frame buffer, configured to send a buffer signal after the first scanning signal is received from the interface module;

a timing controller, configured to send a second scanning signal to the display panel according to the buffer signal sent by the frame buffer;

after the display driving device is switched from a screen self-refresh mode to a vertical synchronization mode, a vertical blank signal is inserted, and the timing controller does not send a second scanning signal after the buffer signal of a first frame period is received, and sends the second scanning signal to the display panel after the buffer signal of a second frame period is received.

10. A display driving method using a display driving device, wherein the display driving device comprises: an interface module, configured to receive image data of a display chip and send a first scanning signal in each frame period; a frame buffer, configured to send a buffer signal after the first scanning signal is received from the interface module; a timing controller, configured to send a second scanning signal to the display panel according to the buffer signal sent by the frame buffer; wherein, when the display driving device is switched to a vertical synchronization mode, delay time between the second scanning signal and the buffer signal gradually decreases, one frame period by one frame period, to zero or gradually increases, one frame period by one frame period, to duration of one frame period, and the method comprises:

receiving, by the interface module, external image data, and sending, by the interface module, the first scanning signal in each frame period;

sending, by the frame buffer, the buffer signal after receiving the first scanning signal from the interface module;

sending, by the timing controller, the second scanning signal to the display panel according to the buffer signal sent by the frame buffer;

wherein, when the display driving device is switched from a screen self-refresh mode to a vertical synchronization mode, the delay time between the second scanning signal and the buffer signal gradually decreases, one frame period by one frame period, to zero or gradually increases, one frame period by one frame period, to duration of one frame period.

11. The display driving method according to claim 10, wherein, the timing controller is configured to set, according to delay time $Td_1$ corresponding to a first image frame after switching to the vertical synchronization mode, the delay time corresponding to each of subsequent image frames, causing the delay time decreases to zero from time $Td_1$ after m image frames.

12. The display driving method according to claim 11, wherein, after $T_{phase1}$ elapses, the delay time gradually decreases to zero from the time $Td_1$, and the time $T_{phase1}$ satisfies a following equation:

$$T_{phase1} = \frac{Td_1}{mT_H} * T_F (0 \le Td_1 \le T_F)$$

where $T_H$ is horizontal synchronization time, $T_F$ is duration of one frame period of the interface module, and m is a first preset synchronization cycle number.

13. The display driving method according to claim 10, wherein, the timing controller is configured to set, according to delay time $Td_1$ corresponding to a first image frame after switching to the vertical synchronization mode, the delay time corresponding to each of subsequent image frames, causing the delay time increases to duration of one frame period from time $Td_1$ after n image frames.

14. The display driving method according to claim 13, wherein, after $T_{phase2}$ elapses, the delay time gradually increases to the duration of one frame period $T_F$ from the time $Td_1$, and the time $T_{phase2}$ satisfies a following equation:

$$T_{phase2} = \frac{(T_F - Td_1)}{mT_H} * T_F (0 \le Td_1 \le T_F)$$

where $T_H$ is horizontal synchronization time, and n is a second preset synchronization cycle number.

15. The display driving method according to claim 10, wherein, when the display driving device is switched to the vertical synchronization mode, the timing controller determines whether the delay time corresponding to a first image frame is less than or equal to half of the duration of one frame period of the interface module;

when the delay time corresponding to the first image frame is less than or equal to half of the duration of one frame period of the interface module, the delay time between the second scanning signal and the buffer signal gradually decreases, one frame period by one frame period, to zero;

when the delay time corresponding to the first image frame is large than half of the duration of one frame period of the interface module, the delay time between the second scanning signal and the buffer signal gradually increases to the duration of one frame period.

16. The display driving method according to claim 15, wherein, after $T_{phase}$ elapses, the second scanning signal and the buffer signal are synchronized, and the time $T_{phase}$ satisfies a following equation:

$$T_{phase} = \begin{cases} \frac{Td_1}{mT_H} * T_F, & 0 \le Td_1 \le \frac{T_F}{2} \\ \frac{(T_F - Td_1)}{nT_H} * T_F, & \frac{T_F}{2} < Td_1 \le T_F \end{cases}$$

where $Td_1$ is the delay time corresponding to the first image frame after switching to the vertical synchronization mode, $T_H$ is horizontal synchronization time, $T_F$ is the duration of one frame period of the interface module, m is a first preset synchronization cycle number and n is a second preset synchronization cycle number.

17. The display driving method according to claim 10, the frame buffer is configured to communicate with the interface module and the timing controller by using separate read data bus and write data bus respectively.

* * * * *